US007384901B2

(12) United States Patent
Joshi et al.

(10) Patent No.: US 7,384,901 B2
(45) Date of Patent: Jun. 10, 2008

(54) PROCESS FOR CLEANING ALUMINUM AND ALUMINUM ALLOY SURFACES WITH NITRIC ACID AND CHROMIC ACID-FREE COMPOSITIONS

(75) Inventors: Nayan H. Joshi, Rock Hill, SC (US); Maulik D. Mehta, Charlotte, NC (US)

(73) Assignee: Atotech Deutschland GmbH, Berlin (DE)

( * ) Notice: Subject to any disclaimer, the term of this patent is extended or adjusted under 35 U.S.C. 154(b) by 3 days.

(21) Appl. No.: 11/734,890

(22) Filed: Apr. 13, 2007

(65) Prior Publication Data

US 2007/0181533 A1 Aug. 9, 2007

Related U.S. Application Data

(63) Continuation of application No. 10/452,111, filed on Jun. 2, 2003, now abandoned.

(51) Int. Cl.
*C11D 7/08* (2006.01)
*C11D 3/395* (2006.01)
*C11D 3/20* (2006.01)

(52) U.S. Cl. ..... 510/254; 510/245; 510/253; 510/269; 510/367; 510/378; 510/375; 510/477; 134/2; 134/3; 134/41; 134/28

(58) Field of Classification Search ..... 510/245, 510/253, 254, 269, 367, 378, 375, 477; 134/2, 134/3, 28, 41
See application file for complete search history.

(56) References Cited

U.S. PATENT DOCUMENTS

| | | | | | |
|---|---|---|---|---|---|
| 3,373,114 | A | * | 3/1968 | Grunwald | 510/254 |
| 3,802,973 | A | | 4/1974 | Smith | 216/103 |
| 3,954,645 | A | * | 5/1976 | Otrhalek et al. | 134/3 |
| 4,126,483 | A | * | 11/1978 | Donakowski et al. | 134/3 |
| 4,362,639 | A | | 12/1982 | Eoga | 510/117 |
| 4,980,076 | A | * | 12/1990 | Tanaka et al. | 252/79.4 |
| 5,292,446 | A | | 3/1994 | Painter et al. | 510/230 |
| 5,336,425 | A | * | 8/1994 | Aoki et al. | 510/254 |
| 5,470,509 | A | | 11/1995 | Pancheri | 510/320 |
| 5,558,881 | A | | 9/1996 | Corby | 424/672 |
| 5,669,980 | A | | 9/1997 | McNeil et al. | 134/3 |
| 5,700,383 | A | * | 12/1997 | Feller et al. | 438/645 |
| 5,709,851 | A | | 1/1998 | Buxton et al. | 424/78.07 |
| 5,723,095 | A | | 3/1998 | Fricker et al. | 422/292 |
| 5,855,805 | A | | 1/1999 | Arabinick | 216/106 |
| 5,866,031 | A | | 2/1999 | Carpio et al. | 252/79.1 |
| 5,896,664 | A | * | 4/1999 | Tsuji et al. | 29/898.14 |
| 6,004,923 | A | | 12/1999 | Oftring et al. | 510/499 |
| 6,015,506 | A | * | 1/2000 | Streinz et al. | 252/186.1 |
| 6,274,540 | B1 | | 8/2001 | Scheibel et al. | 510/352 |
| 6,407,047 | B1 | * | 6/2002 | Mehta et al. | 510/254 |
| 6,468,137 | B1 | | 10/2002 | Fang et al. | 451/41 |
| 6,624,129 | B1 | | 9/2003 | Borch et al. | 510/226 |
| 6,976,905 | B1 | * | 12/2005 | Fang et al. | 451/41 |
| 2002/0111024 | A1 | * | 8/2002 | Small et al. | 438/689 |

FOREIGN PATENT DOCUMENTS

| | | |
|---|---|---|
| GB | 1399111 | 6/1975 |

* cited by examiner

*Primary Examiner*—Charles I Boyer
(74) *Attorney, Agent, or Firm*—Renner, Otto, Boiselle & Sklar, LLP

(57) ABSTRACT

A process for cleaning (e.g., desmutting) an aluminum surface, using compositions free of nitric acid and chromic acid and comprising, in one embodiment, an oxidant and at least one mineral acid salt. In another embodiment, the process uses a composition free of nitric acid and chromic acid and comprising an oxidant, at least one mineral acid salt, and a complexing agent which is a salt of an organic acid. Due at least in part to the absence of nitric and chromic acids, and in particular, strong mineral acids, the cleaning processes of the present invention remove smut residues from aluminum surfaces without significant etching of the aluminum.

15 Claims, No Drawings

PROCESS FOR CLEANING ALUMINUM AND ALUMINUM ALLOY SURFACES WITH NITRIC ACID AND CHROMIC ACID-FREE COMPOSITIONS

CROSS REFERENCE TO RELATED APPLICATION

The present application is a continuation of and claims priority under 35 U.S.C. §120 to commonly owned U.S. application Ser. No. 10/452,111, filed Jun. 2, 2003, now abandoned, the entirety of which is incorporated herein by reference.

FIELD OF THE INVENTION

This invention relates to compositions for cleaning aluminum surfaces, and more particularly, to compositions for cleaning aluminum surfaces that have been subjected to an etching process. The invention also relates to a process for cleaning an aluminum surface.

BACKGROUND OF THE INVENTION

It has long been recognized that aluminum and its alloys require specific surface preparation processes to ensure successful electroplating. The main reason for this requirement is the high affinity of aluminum for oxygen and, as a result, a freshly clean aluminum surface will re-oxidize instantly. This oxide layer has been shown to negatively affect adhesion of plated metal coatings on aluminum if it is not properly controlled.

Pretreatment of aluminum and its alloys prior to electro or electroless plating generally involves several steps including: (1) cleaning, (2) etching, (3) desmutting, and (4) zincating.

Cleaning is performed to remove the various oils, greases, grits, soils and dirts that are present from material handling, corrosion protection, or other surface preparation. Cleaning can involve an array of chemistries and processes including aqueous chemistries, solvent degreasing, vapor degreasing, ultrasonic cleaning etc. Aqueous cleaning by immersion is the most popular process.

After cleaning, aluminum is treated in an alkaline or acidic solution to etch or roughen the surface and remove the heavy oxide layer. Oxide removal makes the surface more electrochemically active. The type of etching employed depends on the aluminum alloy, processing conditions and condition of the surface. An examination of the aluminum surface after etching typically reveals the presence of a loosely adherent film or smut on the surface, which negatively impacts the adhesion of subsequent plating to the aluminum. The composition of this smut depends on the alloy constituents in the aluminum, and generally contains metallic constituents. Thus after etch treatment, the substrate is subjected to a process (desmutting) to remove the smut layer.

A zincating process generally follows desmutting, where the aluminum is immersed in an acid or alkaline zinc bath to deposit a thin zinc-containing layer. The zincate layer controls and minimizes oxidation of the aluminum surface. A typical process sequence after desmutting includes water rinsing, zincating, chemical stripping of zincate layer, zincating the surface again, followed by electrolytic or electroless strike to put permanent metal layer on aluminum.

Experience has shown that desmutting is one of the most critical steps in the aluminum pretreatment process. Historically, nitric acid solutions, with acid concentrations of 25% to 70%, have performed well to desmut etched aluminum alloys. Not all smut is easily removed with nitric acid alone, thus often additions of other components are made to improve the effectiveness of the desmut. For instance, for aluminum alloys containing high concentrations of silicon (e.g., 356 A and 380 series cast alloys), additions of fluoride-containing compounds such as ammonium bifluoride or sodium fluoride, have been added such that fluoride ions are available to dissolve and remove silicon from the surface. Alternatively, a solution of nitric acid, sulfuric acid and a fluoride-containing salt has gained popularity over the years, because of its ability to chemically attack and remove a wider variety of metallic smuts.

While nitric acid has been very effective for desmutting etched aluminum, there has been increased resistance to its use because of safety and health concerns. For instance, development of toxic $NO_x$ fumes in nitric acid-containing baths has been of particular concern. To obviate this concern, there has been significant effort to develop and use non-nitric acid containing desmuts. One such approach has employed the use of chromic acid as the oxidant, again combined with sulfuric acid and a fluoride containing salt. This approach was successful for desmutting and avoids $NO_x$ concerns. However, the use of chromic acid brings with it toxicity concerns of its own.

An object of the present invention is to provide a composition that is free of acids such as nitric acid and chromic acid, thus eliminating the health, safety, and environmental concerns associated with these acids, but which is capable of being highly effective in its desmutting ability.

SUMMARY OF THE INVENTION

Compositions useful particularly for cleaning (desmutting) an aluminum surface is described. The compositions are free of nitric acid and chromic acid, and comprise, in one embodiment, an oxidant and at least one mineral acid salt. In another embodiment, the composition is free of nitric acid and chromic acid, and the composition comprises an oxidant, at least one mineral acid salt, and a complexing agent which is a salt of an organic acid. Aqueous compositions free of nitric acid and chromic acid also are described. Due at least in part to the absence of nitric and chromic acids, and in particular, strong mineral acids, the cleaning compositions of the present invention remove smut residues from aluminum surfaces without significant etching of the aluminum.

DESCRIPTION OF THE EMBODIMENTS

In one embodiment, the present invention relates to compositions which are free of nitric acid and chromic acid, and which comprise (a) an oxidant; and (b) at least one mineral acid salt. Such compositions are useful, in particular, in preparing solutions for cleaning aluminum surfaces, and more particularly, for cleaning aluminum surfaces which have been etched and are characterized as containing smut. When used for cleaning and desmutting, the compositions of the present invention are aqueous compositions which are free of nitric acid and chromic acid and which are prepared by dissolving the oxidant and at least one mineral acid salt in water to provide the desired concentration of oxidant and mineral acid salt(s). Thus, in one embodiment, the compositions of the present invention are aqueous compositions containing from about 0.5 to about 400 g/l of the oxidant and from about 0.5 to about 200 g/l of one or more mineral acid salts, and the aqueous compositions are free of nitric acid and chromic acid. It is to be understood that throughout this written description, all references to the composition of the invention or the aqueous compositions of the invention include the limitation that the composition or aqueous composition is free of nitric acid and chromic acid. In another embodiment the compositions of the invention are free of any mineral acid.

The oxidants which may be included in the compositions of the present invention are compounds which have a high affinity for additional oxygen. One group of oxidants that are included in this group are often referred to as "per" oxidizing agents which include monopersulfates, persulfates, permanganates, peroxides, perborates, percarbonates, perchlorates, perbromates, periodates, etc. Alkali metal or ammonium salts containing one of the above "per" groups may be used. Other oxidants that may be utilized in the compositions of the present invention include chlorates, bromates, iodates, nitrates, etc. such as sodium chlorate, sodium nitrate, and potassium iodate.

Another group of oxidants that may be included in the composition of the invention are the aromatic di- and tri-substituted compounds such as meta-, ortho-, or para-nitro aryl acids; and nitro aryl sulfonic acids and their salts such as the sodium, potassium and ammonium salts.

In one embodiment, $NO_x$ type oxidants such as sodium nitrate; potassium nitrate; nitro containing aromatic di- and tri-substituted compounds such as meta-, ortho-, or para-nitro aryl acids, or nitroaryl sulfonic acids and their salts such as nitrobenzene sulfonic acids and the sodium, potassium and ammonium salts of these acids are not utilized in the compositions of the present invention when it is desired to prepare a composition free of $NO_x$.

In one embodiment, the oxidants utilized in the compositions of the present invention are the "per" oxidizing agents of the type described above. In another embodiment, the oxidants utilized in the compositions of the present invention can be selected from sodium, potassium or ammonium monopersulfate or persulfate. A useful oxidant is a triple salt available from DuPont under the designation "Oxone®". Oxone® is identified as $2KHSO_5$-$KHSO_4$-$K_2SO_4$. The $KHSO_5$ component is an oxidant.

In one embodiment, the aqueous compositions of the invention may contain from about 0.5 to about 400 g/l or more of one or more oxidants. In other embodiments, the concentration of the oxidants may range from about 20 g/l to about 200 g/l or from about 80 g/l to about 100 g/l.

Various water soluble mineral acid salts may be included in the compositions of the invention. Specific examples of the mineral acid salt or salts which can be utilized in the compositions of the present invention include alkali metal and ammonium sulfates and bisulfates. Specific examples include sodium sulfate, sodium bisulfate, potassium sulfate, potassium bisulfate, ammonium sulfate and ammonium bisulfate. Mixtures of such salts can be utilized. A useful commercially available mineral acid salt is Oxone® from DuPont described above. The $KHSO_4$ and $K_2SO_4$ components are effective mineral acid salts in the compositions of the invention.

In one embodiment, the aqueous composition of the invention may contain from about 0.5 g/l to about 200 g/l of one or more of the mineral acid salts. In other embodiments, the salts may be present in amounts of from about 40 g/l to about 100 g/l, or from about 5 g/l to about 10 g/l. The mineral acid salts are utilized in the compositions of the invention to neutralize possible alkaline contaminants and to maintain an acidic pH in the aqueous compositions. Mild acidic conditions maintain the activity of the aqueous cleaning compositions close to their optimum operating level and maintains the composition non-etching to aluminum and aluminum alloys.

As noted above, the compositions of the present invention are free of nitric acid and chromic acid. The term "free of" is intended to reflect that these acids are not intentionally used in the formation of the compositions, and the term "free of" is used to indicate that the aqueous compositions contain less than about 1 g/l of such acids.

The compositions of the present invention also may contain at least one complexing agent which is a salt of an organic acid. The function of such complexing agents is to complex with metal ions present in the desmutting solution and control decomposition of the active species of oxidants. Various salts of various organic acids can be utilized as complexing agents in the compositions of the present invention. In one embodiment, the complexing agents can be selected from alkali metal or ammonium salts of acetic acid, citric acid, tartaric acid, gluconic acid, lactic acid, propionic acid, or mixtures thereof. Specific examples of useful complexing agents include sodium tartrate, sodium gluconate, potassium citrate, potassium gluconate, potassium lactate, etc.

In one embodiment, when a complexing agent is included in the compositions of the present invention, the amount may range from about 0.1 g/l to about 50 g/l. In another embodiment, the amount of complexing agent may range from about 5 g/l to about 25 g/l.

In one embodiment, the aqueous compositions of the present invention may comprise (a) from about 0.5 g/l to about 400 g/l of an oxidant;
(b) from about 0.5 g/l to about 200 g/l of at least one mineral acid salt; and
(c) from about 0.1 g/l to about 50 g/l of a complexing agent which is a salt of an organic acid.

In another embodiment, the aqueous compositions of the invention may comprise (a) from about 20 g/l to about 200 g/l of an oxidant;
(b) from about 10 g/l to about 100 g/l of at least one mineral acid salt; and
(c) from about 5 g/l to about 25 g/l of a complexing agent.

In yet another embodiment, the aqueous compositions of the invention may comprise (a) from about 80 g/l to about 100 g/l of an oxidant;
(b) from about 5 g/l to about 10 g/l of at least one mineral acid salt; and
(c) from about 1 g/l to about 2 g/l of a complexing agent.

In one embodiment, the pH of the aqueous compositions of the present invention may range from about 1 to about 4. In another embodiment, the pH of the aqueous compositions may range from about 2 to about 3. The temperatures of the aqueous compositions of the present invention, when used to clean (desmut) etched aluminum surfaces may range from about 10° C. (50° F.) to about 50° C. (120° F.). In another embodiment, the aqueous compositions of the present invention are utilized at temperatures of from about 21° C. (70° F.) to about 27° C. (81° F.).

The following examples illustrate the compositions of the present invention. The compositions are prepared by mixing the ingredients in water, in any order, with stirring until most or all of the ingredients are dissolved. Unless otherwise indicated in the following examples, and elsewhere in the written description and/or claims, all parts and percentages are by weight, temperatures are in degrees centigrade and pressure is at or near atmospheric pressure.

TABLE 1

| Desmutting Compositions | | | | | | |
|---|---|---|---|---|---|---|
| Example* | A | B | C | D | E | F |
| Sodium Persulfate | 80 | | | 100 | | |
| Hydrogen Peroxide (50%) | | 60 | | | | 50 |
| Triple Salt (Oxone ®) | | | 100 | | | |
| Potassium Permanganate | | | | | 10 | |
| Sodium Bisulfate | 20 | 20 | | | 10 | 15 |
| Sodium Gluconate | | | | 10 | | |
| pH | 2.5 | 2.5 | 2.5 | 2.5 | 2.5 | 2.5 |

*all parts in g/l, remainder is water

The compositions of the present invention are useful for cleaning aluminum surfaces to improve the adhesion of the subsequent metal coatings to the aluminum surfaces. As noted above, this treatment of aluminum surfaces is sometimes referred to in the industry as a desmutting or deoxidizing procedure. The compositions of the present invention are useful in particular in desmutting various aluminum surfaces after such surfaces have been etched in accordance with the processes used in the industry and described briefly herein. The aqueous nitric acid and chromic acid-free compositions are effective in cleaning (desmutting) aluminum while producing no significant etching of the aluminum surface. Moreover, cleaning of the aluminum surfaces with the aqueous compositions of the invention does not impede adhesion when the cleaned surface is plated with a metal such as nickel or copper using electroless or electrolytic plating. The compositions of the invention also are safer to handle and use due to the absence of nitric acid and chromic acid.

In addition to aluminum, the compositions of the present invention are useful for cleaning (desmutting) various etched aluminum alloys including both cast and wrought alloys. Examples of cast alloys include 356, 380 and 383 alloys. Examples of wrought alloys include 1100, 2024 (al-cu), 3003, 3105, 5052, 5056, 6061 (al-Mg), 6063 and 7075 type aluminum alloys.

The utility of the aqueous compositions of the present invention as desmutting compositions is illustrated in the following examples. In all of the examples, the same general cleaning/pretreatment procedure is used prior to the electroless or electrolytic plating step. Test coupons of aluminum alloys are cleaned/degreased in acetone for two minutes, rinsed in deionized water, and then immersed in 2-propanol for five minutes followed by a deionized water rinse. The samples are heated for 30 minutes at 125° C. (250° F.), and then cooled to room temperature. These clean-dry samples are processed through the following process sequence for evaluation of the ability of the compositions of the invention to remove smut from various etched aluminum alloys. After each process step, the aluminum samples are rinsed with water. Unless otherwise indicated, each of the process steps is conducted at a temperature of about 25° C.

| Process Sequence | Time |
|---|---|
| Alklean AC-2 (5%) | 1 minute |
| Desmut Composition | 1 minute |
| Alumseal NCY | 45 seconds |
| Alumseal Activator BD | 30 seconds |
| Alumseal NCY | 25 seconds |
| Electroless or Electrolytic Plating Step | |

Alklean AC-2 is available from Atotech USA Inc., Rock Hill, S.C. and is an acidic, concentrated aqueous etchant containing mineral acids, acid salts, and surface-active agents.

Alumseal NCY is available from Atotech USA Inc., Rock Hill, S.C. and is a non-cyanide zincate process designed specifically to facilitate plating of metallic deposits on aluminum alloys.

Alumseal Activator BD also is available from Atotech USA Inc., Rock Hill, S.C. which, when dissolved in water, provides an acidic solution for stripping zincate layer from the aluminum substrate.

In particular, 1 inch by 4 inch coupons of aluminum alloys are first cleaned/degreased as described above and then etched with the Alklean AC-2 composition. The etched samples are then treated in different non-etch desmut compositions of the invention. The effectiveness of the compositions in removing smut from the etched aluminum alloy surface is determined visually.

The effectiveness of smut removal is rated as: Good when the smut is removed within 30 seconds; Fair when the smut is removed within 60 seconds; and Poor when there is very slow or no smut removal.

The desmutted samples are then processed through zincate steps using Alumseal NCY. The zincate coated aluminum alloys are then plated in Nichem-2500 (Atotech USA) electroless nickel bath for 90 minutes at about 95° C. The nickel plated samples are rinsed with water, dried, and tested for adhesion using a 90° bend test. In this test, after a 90° bending of the nickel plated sample, the inside and outside surfaces of the bent area are evaluated for lift-off (flaking) of the plated metal from the base aluminum substrate. Adhesion of plated metal is rated as: Good (0% lift-off), Fair (less than 5% lift-off on either side of the bent area) or Poor (blisters and very high degree of lift off).

EXAMPLE 1

Samples of cast aluminum alloy 356 and wrought aluminum alloys 2024 and 6061 are cleaned/degreased as described above followed by etching in Alklean AC-2. The etched samples are then immersed in the aqueous composition of Example A, and the ability to remove smut is evaluated. The cleaned samples are then processed through zincate steps followed by electroless nickel plating with Nichem-2500. The desmutting action of a fresh solution of Example A is Good, and the aged solution (after continuous use for three weeks is Fair/Poor. The adhesion of the plated nickel in the 90° bend test to all three alloy samples is Good.

EXAMPLE 2

The procedure of Example 1 is repeated except that the cleaning composition of Example B is used. The desmut action of the fresh cleaning solution is rated as Good, and the rating of an aged solution (used for three weeks) is Poor. The adhesion of the nickel to the three aluminum samples in the 90° bend test is Good.

EXAMPLE 3

The procedure of Example 1 is repeated using samples of wrought aluminum alloy 2024 and the cleaning composition of Example C. The rating for the desmut action of the fresh solution is Good, and the rating for an aged solution (after use for three weeks) is Poor.

EXAMPLE 4

The procedure of Example 3 is repeated except that the cleaning solution is the solution of Example D. The rating for the desmut action of a new solution is Good, and the rating for an aged solution (after three weeks) is Fair/Good.

EXAMPLE 5

Samples of aluminum alloys 356, 2024, 5052, 6061 and 7075 are cleaned and processed as described in Example 1 but utilizing the cleaning solution of Example D. The desmutted samples are plated in an electroless nickel plating bath (Nichem-2500), and a deposit of about 30 microns in thickness is obtained. The results of the desmut action evaluation and the adhesion test on the plated metal deposited on the various aluminum alloys are as follows:

| Aluminum Alloy | Desmut Action | Adhesion of Plated Metal |
|---|---|---|
| 356 | Good | Good |
| 2024 | Good | Good |
| 5052 | Good | Good |
| 6061 | Good | Good |
| 7075 | Good | Good |

EXAMPLES 6-8

In these examples, three cleaning compositions of the invention, Examples D, E, and F respectively, are utilized on aluminum alloy samples, and the effectiveness of these solutions is compared side by side for their performance and stability over a three week period. No replenishment of the cleaning solutions is made throughout the three week period. Alloys 356 and 2024 are used in these examples. Sample coupons are processed through the same sequence described in Example 1. The evaluation of these cleaning solutions is found in the following table. Etching of the aluminum substrate by the aqueous compositions of the invention is evaluated by monitoring of hydrogen evolution, and the amount of smut formed on the aluminum surface.

COMPARATIVE EXAMPLE

A known aqueous acidic desmutting composition is prepared using sulfuric acid (250 g/l), nitric acid (500 g/l) and ammonium bifluoride (80 g/l) in water. This composition is used on the aluminum alloys in the same manner as in Examples 6-8, and the results are summarized in the following table.

| | Composition | | | |
|---|---|---|---|---|
| Test Conditions | Example D | Example E | Example F | Comparative Example |
| Desmut action (new soln.) | | | | |
| 356 alloy | Good | Good | Good | Good |
| 2024 alloy | Good | Good | Good | Good |
| Desmut action (aged soln.) | | | | |
| 356 alloy | Good | Good | Good | Good |
| 2024 alloy | Good | Poor | Poor | Fair/Good |

-continued

| | Composition | | | |
|---|---|---|---|---|
| Test Conditions | Example D | Example E | Example F | Comparative Example |
| Etching (new soln.) | | | | |
| 356 alloy | No etching | No etching | No etching | Low |
| 2024 alloy | No etching | No etching | No etching | Very low |
| Etching (aged soln.) | | | | |
| 356 alloy | No etching | No etching | Very low | High |
| 2024 alloy | No etching | No etching | No etching | Moderate |
| Adhesion (new soln.) | | | | |
| 356 alloy | Good | Good | Good | Good |
| 2024 alloy | Good | Good | Good | Good |
| Adhesion (aged soln.) | | | | |
| 356 alloy | Good | Good | Good | Poor |
| 2024 alloy | Good | Fair | Poor | Fair |
| Solution pH | ~2.5 | ~2.5 | ~2.5 | <1.0 |

EXAMPLE 9

In this example, the cleaning composition of Example D is utilized at two different temperatures, 25° C. (75° F.) and 38° C. (100° F.) for five days without replenishment. Wrought alloy 2024 is used in this evaluation. Prior to the cleaning (desmut) step, the test coupons are processed through the same cleaning and etching steps described in Example 1. The desmut action of this solution at the two temperatures is summarized in the following table.

| Desmut Action | 25° C. | 38° C. |
|---|---|---|
| Day 1 | Good | Good |
| Day 2 | Good | Good |
| Day 3 | Good | Fair/Good |
| Day 4 | Good | Fair |
| Day 5 | Good | Fair/Poor |

While the invention has been explained in relation to its various embodiments, it is to be understood that other modifications thereof will become apparent to those skilled in the art upon reading the specification. Therefore, it is to be understood that the invention disclosed herein is intended to cover such modifications as fall within the scope of the appended claims.

The invention claimed is:

1. A process for pretreating an aluminum or aluminum alloy surface which comprises:

cleaning the surface;

etching the surface; and applying to the etched surface a composition free of nitric and chromic acid which comprises:

an oxidant;

at least one mineral acid; and at least one complexing agent which is a salt of an organic acid;

wherein the composition has a pH in the range from about 2 to about 3.

2. The process of claim 1 wherein the applying comprises desmutting the surface.

3. The process of claim 1 wherein the etching results in formation of a smut on the surface.

4. The process of claim 1 further comprising zincating the surface subsequent to the applying.

5. The process of claim 1 wherein the applying substantially does not etch the surface.

6. The process of claim 1 wherein the oxidant is a monopersulfate, persulfate, permanganate, peroxide, perborate, percarbonate, chlorate, bromate, iodate, perchlorate, perbromate, periodate, or a mixture of two or more of said oxidants.

7. The process of claim 1 wherein the mineral acid salt is a sodium, potassium, or ammonium sulfate or bisulfate.

8. The process of claim 1 wherein the composition is an aqueous composition containing from about 1 to about 400 g/l of the oxidant and from about 0.5 to about 100 g/l of one or more mineral acid salts.

9. The process of claim 1 wherein the complexing agent is an alkali metal or ammonium salt of acetic acid, citric acid, tartaric acid, gluconic acid, lactic acid, propionic acid, or mixtures thereof.

10. A process for pretreating an aluminum or aluminum alloy surface which comprises:

cleaning the surface;

etching the surface, wherein the etching results in formation of a smut on the surface;

desmutting the etched surface by applying thereto a composition free of nitric and chromic acid which comprises:

an oxidant;

at least one mineral acid salt; and at least one complexing agent which is a salt of an organic acid, wherein the composition has a pH in the range from about 2 to about 3; and zincating the surface subsequent to the applying.

11. The process of claim 10 wherein the applying substantially does not etch the surface.

12. The process of claim 10 wherein the oxidant is a monopersulfate, persulfate, permanganate, peroxide, perborate, percarbonate, chlorate, bromate, iodate, perchlorate, perbromate, periodate, or a mixture of two or more of said oxidants.

13. The process of claim 10 wherein the mineral acid salt is a sodium, potassium, or ammonium sulfate or bisulfate.

14. The process of claim 10 wherein the composition is an aqueous composition containing from about 1 to about 400 g/l of the oxidant, from about 0.5 to about 100 g/l of one or more mineral acid salts, and from about 0.1 to about 50 g/l of the complexing agent.

15. The process of claim 10 wherein the complexing agent is an alkali metal or ammonium salt of acetic acid, citric acid, tartaric acid, gluconic acid, lactic acid, propionic acid, or mixtures thereof.

* * * * *